United States Patent [19]

Rodrique

[11] Patent Number: 4,492,829

[45] Date of Patent: Jan. 8, 1985

[54] TACTILE MEMBRANE KEYBOARD WITH ASYMMETRICAL TACTILE KEY ELEMENTS

[75] Inventor: Leo J. Rodrique, Ipswich, Mass.

[73] Assignee: Rogers Corporation, Rogers, Conn.

[21] Appl. No.: 579,814

[22] Filed: Feb. 13, 1984

Related U.S. Application Data

[63] Continuation of Ser. No. 352,310, Feb. 25, 1982, abandoned.

[51] Int. Cl.[3] ..... H01H 13/70

[52] U.S. Cl. ..... 200/5 A; 200/159 B; 200/329

[58] Field of Search ..... 200/5 R, 5 A, 83 R, 200/83 N, 86 R, 159 B, 275, 292, 314, 317, 329

[56] References Cited

U.S. PATENT DOCUMENTS

| | | | |
|---|---|---|---|
| 3,699,294 | 10/1972 | Sudduth | 200/83 R X |
| 3,860,771 | 1/1975 | Lynn et al. | 200/5 A |
| 3,932,722 | 1/1976 | Obata et al. | 200/5 A X |
| 4,060,703 | 11/1977 | Everett, Jr. | 200/317 |
| 4,096,364 | 6/1978 | Lynn et al. | 200/5 A |
| 4,127,752 | 11/1978 | Lowthorp | 200/5 A |
| 4,129,758 | 12/1978 | Gilano et al. | 200/5 A |
| 4,156,802 | 5/1979 | Gilano et al. | 200/5 A |
| 4,314,116 | 2/1982 | Gordon | 200/5 A |
| 4,323,740 | 4/1982 | Balash | 200/5 A |
| 4,343,975 | 8/1982 | Sado | 200/314 |

FOREIGN PATENT DOCUMENTS

| | | | |
|---|---|---|---|
| 2442502 | 7/1980 | France | 200/5 A |
| 655549 | 7/1951 | United Kingdom . | |
| 1451970 | 10/1976 | United Kingdom . | |
| 1503253 | 3/1978 | United Kingdom . | |
| 1556722 | 11/1979 | United Kingdom . | |
| 2036434 | 6/1980 | United Kingdom | 200/5 A |
| 1580958 | 12/1980 | United Kingdom . | |
| 2058458 | 4/1981 | United Kingdom . | |

*Primary Examiner*—J. R. Scott

*Attorney, Agent, or Firm*—Fishman & Dionne

[57] ABSTRACT

A tactile or snap action membrane keyboard is presented wherein the tactile or snap action key elements are protrusions in a membrane sheet, the protrusions being asymmetrical to preprogram the collapse of the tactile element.

26 Claims, 10 Drawing Figures

TACTILE MEMBRANE KEYBOARD WITH ASYMMETRICAL TACTILE KEY ELEMENTS

This application is a continuation of application Ser. No. 352,310, filed Feb. 25, 1982 now abandoned.

BACKGROUND OF THE INVENTION

This invention relates to the field of tactile or snap action keyboards. More particularly, this invention relates to the field of tactile or snap action elements which are in the form of protrusions in a plastic sheet. As is well known in the art of tactile or snap action membrane keyboards, tactile or snap action protrusions may be formed in a sheet of Mylar (a trademark of E. I. DuPont DeNamours and Co.) material or other suitable plastic material. The protrusions are sometimes referred to as "bubbles", although several different geometric configurations of the "bubbles" are known in the art. By way of example, U.S. Pat. No. 3,643,041 to Jackson discloses a snap action keyboard in which the protrusions are in the form of semi-spherical domes; U.S. Pat. No. 3,860,771 to Lynn et al shows a snap action keyboard in which the key elements are in the form of semi-spherical domes located on top of cylindrical pedestals; and U.S. Pat. No. 4,190,748 to Langford discloses a tactile keyboard in which the tactile key elements are in the form of truncated cones. While those three patents are by no means a complete list of all prior art in the field of tactile keyboard elements, they do illustrate what are believed to be the most commonly used geometric configurations for these tactile key elements.

Although the geometric configurations of the tactile key elements are different in the three patents cited above and other geometric configurations may exist, a characteristic believed to be common to all geometric configurations of tactile key elements is that they are symmetrical. Thus, in the three patents identified above, the tactile key elements are, when viewed in cross section, symmetric with respect to a center axis through the elements; and in these three cases at least, the tactile elements are also symmetric surfaces of revolution about their center axes. As stated, this characteristic of symmetry (either in cross section or in surface of revolution) is believed to be incorporated in all tactile or snap action key elements of membrane type keyboards.

A problem often encountered with prior art tactile or snap action membrane keyboards is that the consistency of snap action or tactile feel (or tactile feedback as it is sometimes called) may be very sensitive to the place and manner of application of the actuating force. Many of these snap action protrusions or bubbles require actuation essentially at the center of the bubble to obtain proper and consistent snap action, while others, such as the configuration shown in Langford U.S. Pat. No. 4,190,748, may be actuated at an off center design location; but in all cases, the quality and consistency of snap action is very sensitive to the location at which the actuating force is applied. If the actuating force is not applied within the design tolerances of the actuating point, or if the location of the actuating force is applied inconsistently, inconsistent and often unacceptable (sometimes bordering on nonexistent) snap action or tactile feel may result. As a result of this sensitivity of prior art snap action key elements to the location of the actuating forces, prior art keyboards of this type have been very sensitive to manufacturing and assembly tolerances; and unacceptable products may result if manufacturing tolerances or alignment tolerances in assembly are exceeded. The problem of inconsistency of snap action or tactile feedback is particularly present in keyboards which have a relative thick or stiff overlay sheet, such as an electroluminescent panel or an embossed overlay sheet. The sensitivity of these prior art tactile keyboards therefore complicates both the assembly and operation of these keyboards and increases their expense.

SUMMARY OF THE INVENTION

The tactile keyboard of the present invention incorporates asymmetric tactile or snap action key elements in a membrane type keyboard. The asymmetric tactile or snap action key elements of the present invention do not have the sensitivity of the prior art key elements to location of the actuating force. The actuation and tactile response of the asymmetric key elements of the present invention remain essentially constant even though the location of the actuating force may vary or be inconsistent. Thus, keyboard assemblies using the configuration of the present invention have much less critical tolerance requirements and are more "forgiving" with regard to assembly alignment and location or type of actuation as compared to the more critical requirements of prior art membrane keyboards of this type.

BRIEF DESCRIPTION OF THE DRAWINGS

Referring now to the drawings, wherein like elements are numbered alike in the several FIGURES:

FIG. 1(*b*) is a sectional view taken along line (b)—(b) of FIG. 1(*a*).

FIG. 1(*c*) is a sectional view taken along line (c)—(c) of FIG. 1(*a*).

FIG. 1(*d*) is a top plan view of the key element of FIG. 1(*a*).

DESCRIPTION OF THE PREFERRED EMBODIMENT

Figure 1:
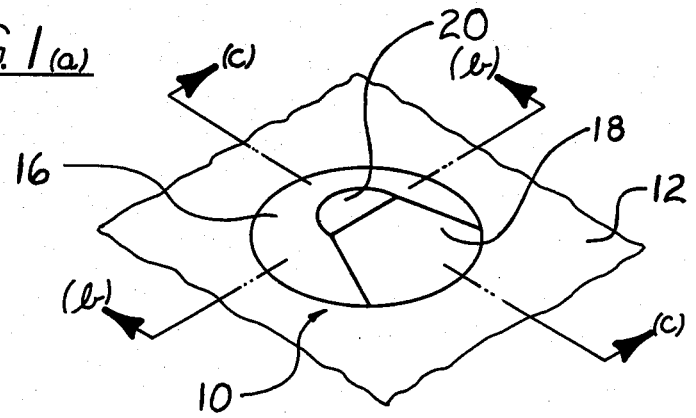
FIG. 1(*a*) is a perspective view of an asymmetric membrane key element in accordance with the present invention.
Figure 1:
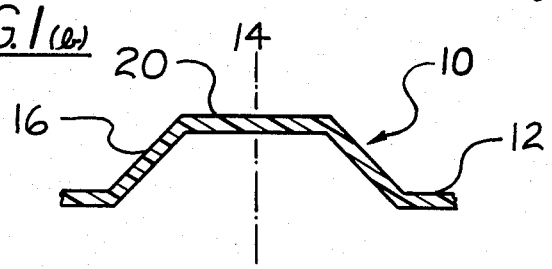
Figure 1:
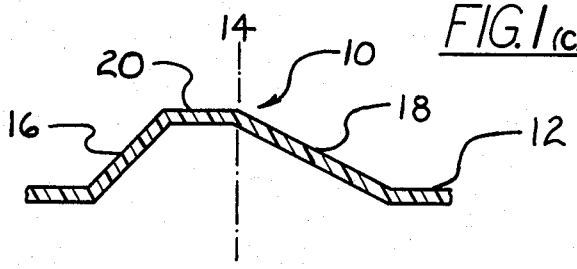
Figure 1:
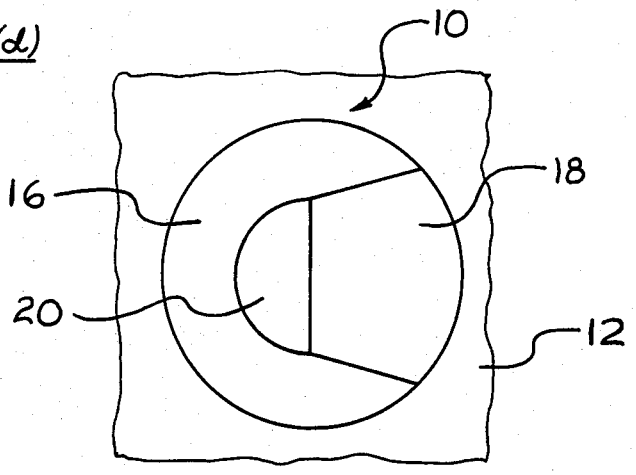

Referring first to the series of FIGS. 1(*a*) through 1(*d*), a single snap action or tactile bubble or key is shown. The bubble, indicated generally at 10, is in the form of a protrusion from a base sheet 12 of plastic material, preferably polyester Mylar, or other suitable flexible plastic material. The plastic key 10 is a modified version of the snap action projections of U.S. Pat. No. 4,190,748 (identified as item 28 in that patent). The projections in that prior patent were in the form of a truncated right circular cone having a flat top and conical side walls and being symmetric about a center axis. The snap acting keys of the present invention differ in that they are asymmetric. In the configuration shown in FIGS. 1(*a*) through 1(*d*), the keys 10 are asymmetric about a center axis 14, and they may also be considered asymmetric when viewed relative to section line (c)—(c). The key configuration of the present invention has a partial conical side wall 16, the symmetry of which is interrupted by a discontinuous or irregular section 18 which may be considered to be an elongated ramp. The conical section 16 terminates at a flat top surface 20 which would be a full circle if the conical section 16 were a complete surface of revolution. However, the ramp 18 intersects flat top 20 at a point at or about a diameter thereof, so that flap top 20 in the present invention is only a semi or partial circular segment.

The particular asymmetric configuration shown and described with respect to FIGS. 1(*a*) to 1(*d*) is a presently preferred asymmetric configuration, but it is to be understood that other asymmetric configurations (either of the flat top bubble of U.S. Pat. No. 4,190,748 or the semi-spherical bubbles of U.S. Pat. Nos. 3,643,041 or 3,860,771 or other bubble configurations) are within the scope of the present invention. The important point is that the bubble or key structure be intentionally constructed to have one or more areas of asymmetry or irregularity. While only one ramp area of irregularity or asymmetry is shown herein, it will be understood that two or more irregularities or areas of asymmetry may be present, so long as the bubble is asymmetric with respect to an axis or plane. This asymmetry or irregularity in the key configuration preprograms the collapse of the key when an actuating force is applied to the key (in a downward direction in the views indicated in FIGS. 1(*a*) through 1(*d*) and makes the snap action or tactile feel consistent even though the actuating force may not be applied consistently at the intended point of force application for proper actuation of the key. This consistency of actuation and tactile feel is particularly important in keyboard structures where the keyboard has a flat overlay surface to which the actuating force is applied, and even more particularly when the flat overlay surface is relatively thick (such as in the range of 0.02 inches) and/or relatively stiff. These relatively thick or stiff overlays may be found in keyboard constructions in which the overlay is an electroluminescent panel or an embossed panel, merely by way of example. The use of key structure in accordance with the present invention results in a keyboard in which snap action is consistent even in the presence of these thick or stiff overlays and/or inconsistent application of actuating force. The structure of the present invention also reduces the need to be concerned about precise alignment in assembly of the keyboards, because key actuation remains relatively consistent even though the various parts of the keyboard structure may not be precisely aligned.

Figure 2:
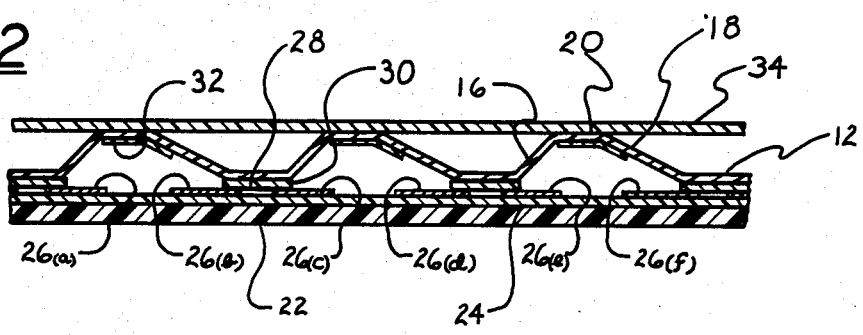
FIG. 2 is a partial sectional elevation view of a keyboard construction incorporating and in accordance with the present invention.

Referring now to FIG. 2, a keyboard configuration is shown incorporating the structure of the present invention. It will be understood that the structure shown in FIG. 2 (as well as in FIGS. 3, 4 and 5) is only a partial elevation view of a keyboard assembly, with details such as case or bezel and mechanical and electrical interconnections not being shown because they are not needed to understand the structure and operation of the present invention. The keyboard assembly of FIG. 2 has a rigid back or reinforcing board 22 which may be hard plastic such as Bakelite, fiberboard or other suitable support material. A layer of flexible plastic insulating material 24, such as Mylar or other suitable insulating material, is positioned on one side of backing board 22 and may be adhered to the backing board. Conductive circuit patterns 26(*a*) through 26(*f*), such as copper or conductive ink (which may be formed by printed circuits or other techniques), are on the top side of insulating layer 24; the plastic sheet 24 and conductive patterns 26(*a*) through 26(*f*) being, in effect, a unitary layer of printed circuitry. It will be observed that portions of two conductive circuit patterns extend under each asymmetric bubble or key to be electrically connected by actuation of the bubble or key. A plastic spacer 28 is positioned on top of insulating sheet 24, and spacer 28 may be adhered to sheet 24. Plastic spacer 28 (which may also be Mylar) has a series of circular openings 30, each of which is aligned with a pair of circuit lines (such as lines 26(*a*) and 26(*b*)) and with an associated asymmetric key element 10. The asymmetric key elements 10 are each formed out of sheets 12 in accordance with the structure and explanation previously set forth with regard to FIGS. 1(*a*) through 1(*d*). Each asymmetric key 10 has an electrically conductive shorting element (such as conductive ink or copper) on its undersurface beneath the circular top portion 20 and may extend at least partly under the asymmetric or ramp portion 18. Sheet 12 is initially a flat piece of flexible printed circuitry having the shorting elements 32 thereon. The asymmetric bubbles or keys may be formed with shaped tooling under heat and pressure by techniques known in the art. Flat portions of sheet 12 may be adhered to spacer sheet 28.

A flat cover to overlay sheet 34 is located and positioned to be in contact with the flat top portion 20 of each asymmetric key 10, and the upper portion of overlay sheet 34 (i.e., the side not in contact with the asymmetric keys) may have numbers, letters or other key identifying indicia thereon to be read by the user of the keyboard. In a particularly important construction of the present invention, the overlay sheet 34 is relatively thick or relatively rigid, as a result of, for example, being an electroluminescent panel or being an embossed panel.

An asymmetric key 10 and its associated circuitry on sheet 24 constitute, in effect, a key station. In operation of the keyboard of FIG. 2, the user locates the particular key station which is desired to be actuated (such as by reading the indicia on the top of sheet 34). The user then pushes downwardly on that key to bring a shorting element 32 into contact with a pair of circuit patterns, such as 26(*a*) and 26(*b*) to interconnect those circuit patterns and generate an electrical signal from the keyboard. When the downward force is applied to a key 10, the key collapses downwardly with a snap action and tactile feel or tactile feedback to the user. As has been previously stated, because of the asymmetric key configuration of the present invention, the snap action and tactile feedback remain relatively consistent notwithstanding the thickness of the overlay sheet 34 and notwithstanding inconsistency in the location or direction of the actuating force applied to a particular key and notwithstanding minor misalignments in the structure of the keyboard assembly.

Figure 3:
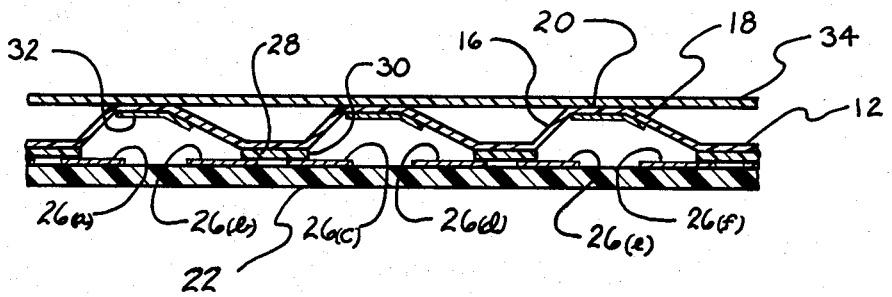
FIG. 3 is a partial sectional elevation view, similar to FIG. 2, of a second keyboard configuration incorporating and in accordance with the present invention.

Referring now to FIG. 3, another keyboard assembly in accordance with the present invention is shown. The keyboard assembly of FIG. 3 is similar to that of FIG. 2 with the exception that the plastic insulating sheet 24 is omitted and the circuit patterns 26 are formed directly on backer layer 22.

Figure 4:
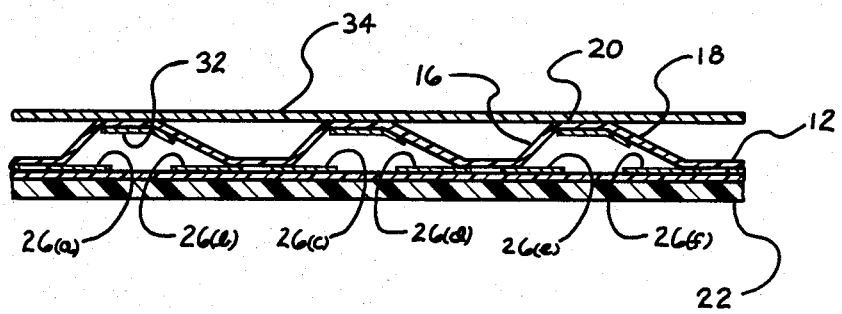
FIG. 4 is a partial sectional elevation view of still another keyboard configuration, similar to FIG. 2, incorporating and in accordance with the present invention.

Referring now to FIG. 4, the keyboard assembly is similar to that shown in FIG. 2 with the exception that the spacer layer 28 is omitted. Because of the preprogrammed key collapse and consistency of key operation resulting from the structure of the present invention, it is possible, in some keyboard embodiments, to eliminate the insulating spacer 28 typically found in membrane keyboards of this type. The ability to eliminate the insulating spacer is the result of the fact that only a shorting contact is present on the underside of the snap action key element, combined with the fact that the preprogrammed key collapse of the asymmetric key configuration leads to reliable actuation of the key to which the actuating force is applied, even though the application of the actuating force may not be precisely directed to the design actuating point of the key.

Figure 5:
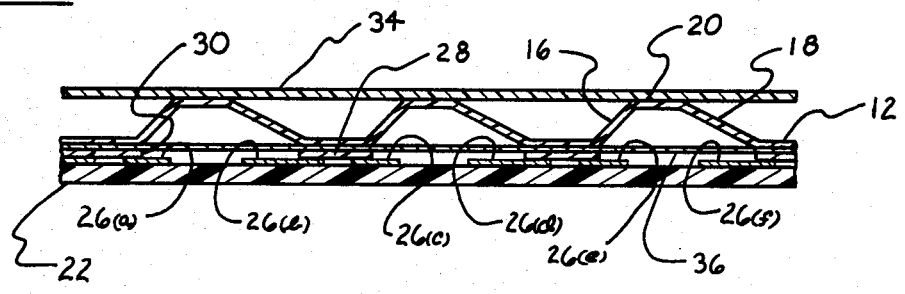
FIG. 5 is a partial sectional elevation view of still another keyboard configuration, similar to FIG. 2, incorporating and in accordance with the present invention.

Referring now to FIG. 5, still another keyboard assembly configuration is shown incorporating the present invention. The structure shown in FIG. 5 is similar to that of FIG. 3, but with the important difference that a sheet with conductive material, such as the conductive elastomer material disclosed in U.S. Pat. No. 3,699,294 to Sudduth, a metal sheet, or a sheet of insulation with conductive material thereon is located between base sheet 12 (and the included keys 10 of base sheet 12) and the insulating spacer 28. Also, in the configuration of FIG. 5 there is no shorting element on the underside of the individual keys 10. In the FIG. 5 configuration the keys 10 act as actuators to move portions of the conductive elastomer sheet 36 though associated openings in the spacer to cause bridging or shorting contact between associated circuit pattern elements 26 on backer 22. Thus, in the configuration of FIG. 5, actuating force applied to overlay sheet 34 on top of one of the keys 10 will cause that key to collapse, with attendant snap action and tactile feedback, whereby the key will then come in contact with the aligned portion of conductive elastomer sheet 36 and move that aligned portion of conductive elastomer sheet 36 through its associated opening 30 in spacer 28 to bring the conductive elastomer into shorting or bridging contact with the circuit elements 26 in alignment therewith.

Figure 6:
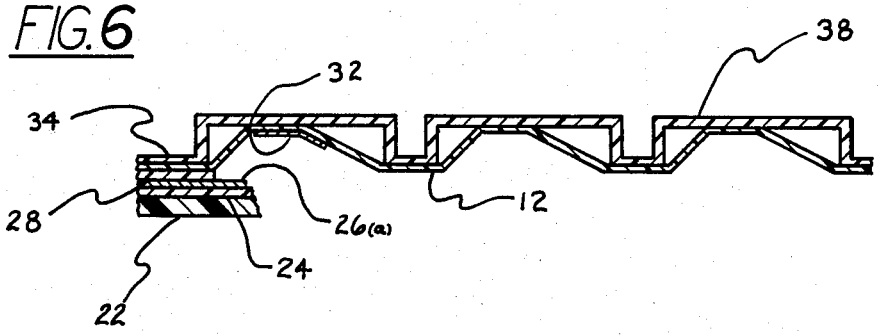
FIG. 6 is a view similar to FIG. 2 showing one form of embossed cover sheet.
Figure 7:
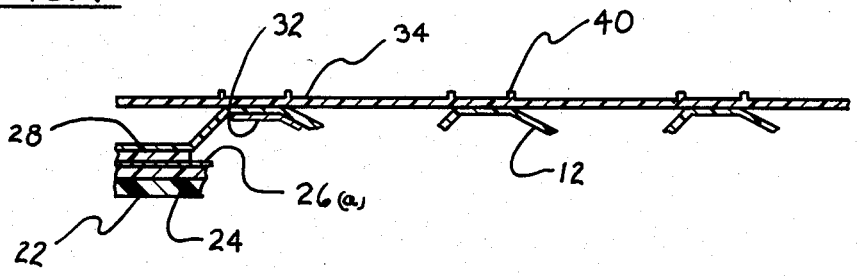
FIG. 7 is a view similar to FIG. 2 showing another form of embossed cover sheet.

FIGS. 6 and 7 show two forms of keyboard construction with embossed overlay sheets. The keyboard of FIG. 6 differs from FIG. 2 in that the cover sheet 34 is embossed, as shown, to form, in effect, housings 38 about the keys 10. The keyboard of FIG. 7 differs from FIG. 2 in that cover sheet 34 is embossed to define raised ridges 40 about each key 10. This embossing, which serves to define key locations on sheet 34, results in a cover sheet which is more stiff than would otherwise be the case.

It will be understood that the features and advantages of the asymmetric key configuration generally described above are realized in all of the various keyboard structures shown in FIGS. 2–5 and may also be realized in other variance of these keyboard structures, all of which are deemed to be within the scope of the present invention.

I claim:

1. A tactile snap action switch element comprising:

a sheet of base material; and at least one snap action protrusion having a first wall segment and a second wall segment formed in said sheet of base material, said protrusions being asymmetric with respect to a center axis thereof or a plane containing said center axis.

2. A tactile snap action switch element as in claim 1 wherein:

said protrusion has a first section in the shape of a portion of a surface of revolution, and at least one second section in a shape different from said first section.

3. A tactile snap action switch element as in claim 1 wherein:

said protrusion has a first section in the shape of a portion of a truncated cone, and at least one second section in a shape different from said first section.

4. A tactile snap action switch element as in claim 3 wherein:

said second section is an elongated ramp intersecting said first section.

5. A keyboard comprising:

a sheet of base material;

a plurality of tactile elments formed in said sheet of base material, each of said tactile elements being a protrusion in said base material, each of said protrusions having a first wall segment and a second wall segment, said protrusions being asymmetric with respect to a center axis thereof or a plane containing said center axis;

first electrically conductive means associated with each tactile element; and second electrically conductive means aligned with each of said tactile elements, said first electrically conductive means contacting said second electrically conductive means to complete an electric circuit upon actuation of each of said tactile elements.

6. A keyboard as in claim 5 wherein:

each of said tactile elements has a first section in the shape of a portion of a surface of revolution, and at least one second section in a shape different from said first section.

7. A keyboard as in claim 5 wherein:

each of said tactile elements has a first section in the shape of a portion of a truncated cone, and at least one second section in a shape different from said first section.

8. A keyboard as in claim 7 wherein:

said second section is an elongated ramp intersecting said first section.

9. A keyboard as in claim 5 wherein:

said first electrically conductive means is a contact on said tactile element.

10. A keyboard as in claim 5 wherein:

said first electrically conductive means is sheet means spaced from said tactile element.

11. A keyboard as in claim 5 wherein:

said first electrically conductive means is conductive elastomer means spaced from said tactile element.

12. A keyboard as in claim 5 further including:

overlay means positioned over said tactile elements.

13. A keyboard as in claim 12 wherein:

said overlay means is an electroluminescent panel.

14. A keyboard as in claim 12 wherein:

said overlay means is an embossed cover sheet.

15. A tactile snap action switch element comprising:

a sheet of base material; and at least one snap action protrusion formed in said sheet of base material, said protrusion having a first wall section which is part of a surface of revolution about an axis and a second wall section which is other than a surface of revolution about said axis, whereby said protrusion is asymmetric with respect to said axis or a plane containing said axis.

16. A tactile snap action switch element as in claim 15 wherein:

said first section is in the shape of a portion of a truncated cone, and said second section is a segment of shape different from said first section.

17. A tactile snap action switch element as in claim 16 wherein:

said second section is an elongated ramp intersecting said first section.

18. A keyboard comprising:

a sheet of base material;

a plurality of tactile elements formed in said sheet of base material, each of said tactile elements being a protrusion in said base material, said protrusion having a first wall section which is part of a surface of revolution about an axis and a second wall section which is other than a surface of revolution about said axis, whereby said protrusion is asymmetric with respect to said axis or a plane containing said axis;

first electrically conductive means associated with each tactile element; and second electrically conductive means aligned with each of said tactile elements, said first electrically conductive means contacting said second electrically conductive means to complete an electric circuit upon actuation of each of said tactile elements.

19. A keyboard as in claim 18 wherein:

said first section is in the shape of a portion of a truncated cone, and said second section is a segment of shape different from said first section.

20. A keyboard as in claim 19 wherein:

said second section is an elongated ramp intersecting said first section.

21. A keyboard as in claim 18 wherein:

said first electrically conductive means is a contact on said tactile element.

22. A keyboard as in claim 19 wherein:

said first electrically conductive means is sheet means spaced from said tactile element.

23. A keyboard as in claim 18 wherein:

said first electrically conductive means is conductive elastomer means spaced from said tactile element.

24. A keyboard as in claim 18 further including:

overlay means positioned over said tactile elements.

25. A keyboard as in claim 24 wherein:

said overlay means is an electroluminescent panel.

26. A keyboard as in claim 24 wherein:

siad overlay means is an embossed cover sheet.

* * * * *